US005167210A

United States Patent [19]

Leroy

[11] Patent Number: 5,167,210

[45] Date of Patent: Dec. 1, 1992

[54] INJECTOR DEVICE FOR AN INTERNAL COMBUSTION ENGINE

[75] Inventor: Jean-Louis Leroy, Paris, France

[73] Assignee: S.E.M.T. Pielstick, Saint Denis, France

[21] Appl. No.: 708,651

[22] Filed: May 31, 1991

[30] Foreign Application Priority Data

Jun. 7, 1990 [FR] France ..... 90 07097

[51] Int. Cl.[5] ..... F02M 45/04

[52] U.S. Cl. ..... 123/300

[58] Field of Search ..... 123/276, 299, 300

[56] References Cited

U.S. PATENT DOCUMENTS

| | | | |
|---|---|---|---|
| 4,368,702 | 1/1983 | Finsterwalder et al. | 123/299 X |
| 4,399,786 | 8/1983 | Holmer | 123/299 X |
| 4,524,737 | 6/1985 | Hofman | 123/300 |
| 4,549,511 | 10/1985 | Grieshaber et al. | 123/300 X |
| 4,612,989 | 9/1986 | Steiger et al. | 123/299 |

FOREIGN PATENT DOCUMENTS

| | | |
|---|---|---|
| 0309590 | 4/1989 | European Pat. Off. . |
| 3214096 | 11/1982 | Fed. Rep. of Germany . |
| 3742759 | 9/1988 | Fed. Rep. of Germany . |
| 1426578 | 12/1965 | France . |
| 2006797 | 1/1970 | France . |
| 2463861 | 2/1981 | France . |
| 2068460 | 8/1981 | United Kingdom . |

OTHER PUBLICATIONS

Patent Abstracts of Japan, vol. 9, No. 313 (M-437)(2036), Dec. 10, 1985, & JP-A-60 147525 (Mitsubishi Jukogyo) Aug. 3, 1985.

*Primary Examiner*—Tony M. Argenbright

*Attorney, Agent, or Firm*—Sughrue, Mion, Zinn, Macpeak & Seas

[57] ABSTRACT

A fuel injection device for an internal combustion engine, in particular a diesel engine, the device is of the type comprising two spray heads, one spray head serving for pre-injection of fuel while the other serves for main injection of fuel, said spray heads being situated close to each other in the vicinity of the middle of the cylinder head. The pre-injection spray head includes a series of holes whose axes lie on a frist cone and the main injection spray head inlcudes a series of holes whose axes lie on a second cone, there being twice as many holes in the main spray head as in the pre-injection spray head, the relative positions of the cones, the angle of each of the cones, and the directions of the axes of the holes around the cones being selected in such a manner that the distances between each pre-injection jet and the two adjacent main injection jets are at a minimum and are substantially equal in a zone which is situated substantially halfway along the main injection jets.

2 Claims, 3 Drawing Sheets

INJECTOR DEVICE FOR AN INTERNAL COMBUSTION ENGINE

The invention relates to an injection device for an internal combustion engine, and more particularly for a diesel engine, the engine using a main injection fuel and a pre-injection fuel that may differ from the main injection fuel.

BACKGROUND OF THE INVENTION

When fuels having low ignition quality (fuels having a low cetane number) are used in diesel engines, the must be replaced at low speed and at low load by a fuel having higher ignition quality. This has the particular drawback of considerably increasing engine operating costs.

To remedy this drawback, engines may be equipped with a device for pre-injecting a high ignition quality fuel, with pre-injection being used whenever engine running conditions no longer ensure proper combustion of low cetane number fuel. Such a device is described, for example, in U.S. Pat. No. 4,612,898 which shows a combustion chamber with a plurality of nozzles for injecting a low ignition quality main fuel together with an additional nozzle for injecting a high ignition quality fuel. Nevertheless, the low ignition quality fuel operating range guaranteed by presently known systems is inadequate.

The problem may be expressed as follows:

Operation of the engine at high load using a low ignition quality fuel that is relatively cheap is satisfactory.

If the load on the engine falls off progressively, there comes a point where proper combustion requires injection of an additional fuel having high ignition quality and which is expensive.

An object of the invention is to provide an ignition device making it possible to "delay" as much as possible the instant at which it becomes necessary to use pre-injection of a high ignition quality fuel, with the quantity of pre-injection fuel being kept as low as possible for reasons of cost. An object of the present invention is to provide an injection device enabling the engine to operate with low ignition quality fuel over a wider operating range.

SUMMARY OF THE INVENTION

The present invention provides a fuel injection device for an internal combustion engine, in particular a diesel engine, the device being of the type comprising two spray heads combined in a single body or situated in separate bodies, one spray head serving for pre-injection of fuel while the other serves for main injection of fuel, the fuels being different or the same, said spray heads being situated close to each other in the vicinity of the middle of the cylinder head, being provided with fuel spray holes that are equidistant or otherwise, and being under the control of different needles, wherein the pre-injection spray head includes a series of holes whose axes lie on a first cone and the main injection spray head includes a series of holes whose axes lie on a second cone, there being twice as many holes in the main spray head as in the pre-injection spray head, the relative positions of the cones, the angle of each of the cones, and the directions of the axes of the holes around the cones being selected in such a manner that the distances between each pre-injection jet and the two adjacent main injection jets are at a minimum and are substantially equal in a zone which is situated substantially halfway along the main injection jets.

The holes of the pre-injection spray head may comprise, in the fuel flow direction, a cylindrical portion followed by a flared portion which is flared towards the combustion chamber, with the length of each flared portion being less than 80% of the wall thickness.

BRIEF DESCRIPTION OF THE DRAWINGS

An embodiment of the invention is described by way of example with reference to the accompanying drawings, in which.

DETAILED DESCRIPTION

Figure 1:
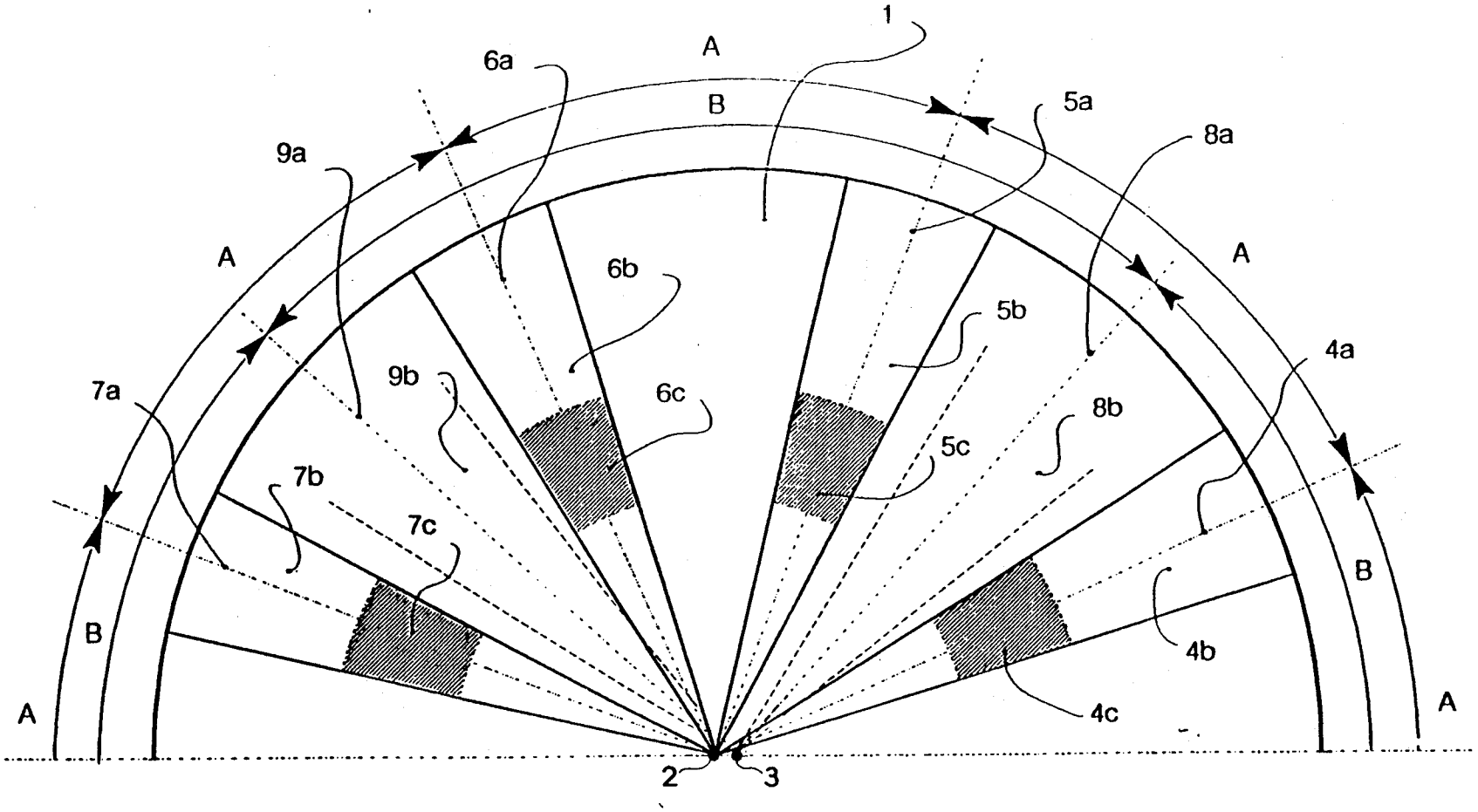
FIG. 1 is a diagram showing the distribution of main injection and pre-injection jets inside the combustion chamber.

FIG. 1 is a half cross-section through the combustion chamber 1 of an internal combustion engine fitted with a device of the invention. Close to the center of the combustion chamber, a main injection spray head 2 and a pre-injection spray head 3 are shown diagrammatically. The main injection spray head is provided with a series of spray holes having axes 4*a*, 5*a*, 6*a*, and 7*a* at a uniform angular spacing A, while the pre-injection spray head is provided with a series of spray holes having axes 8*a*, 9*a* at a uniform angular spacing B. The main injection spray head 2 has twice as many holes as the pre-injection spray head 3.

Figure 2:
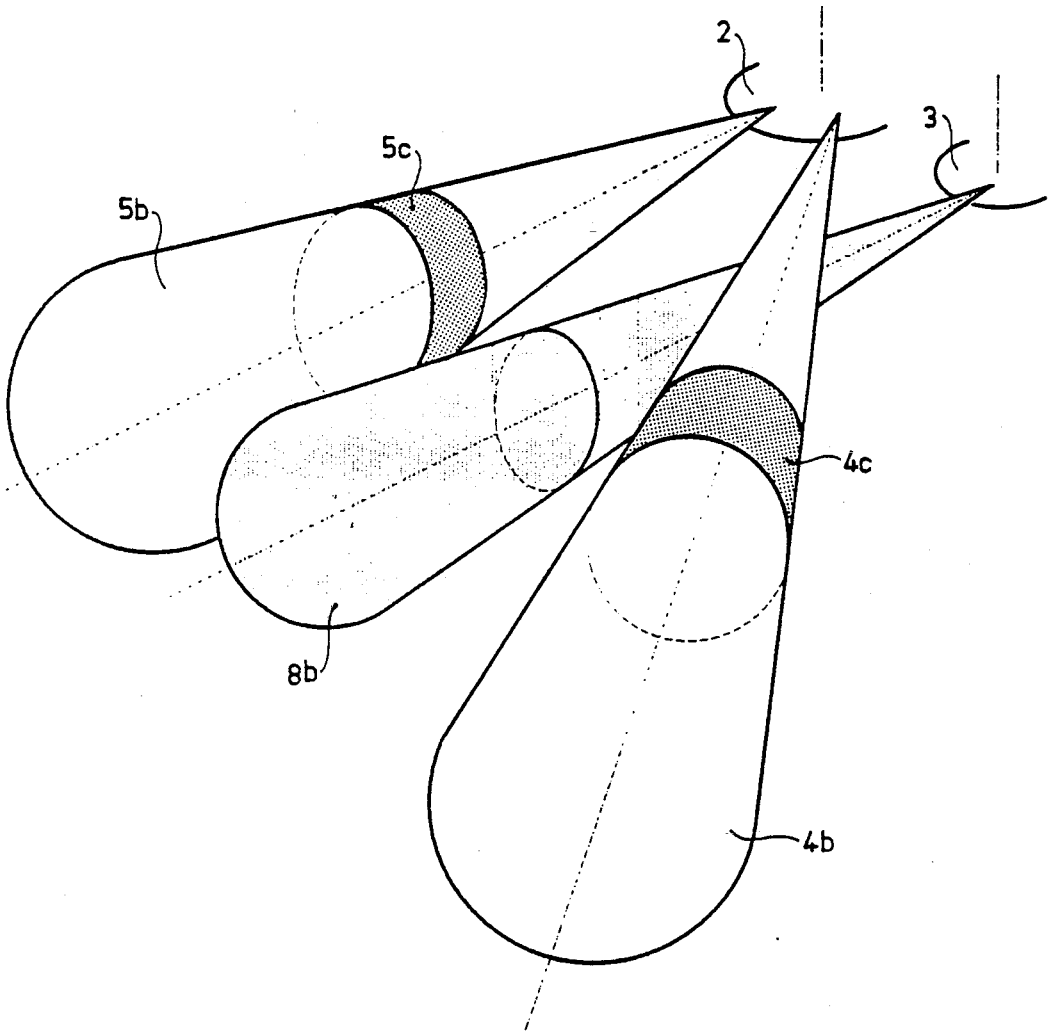
FIG. 2 is a diagrammatic perspective view showing the relative dispositions of the main jets and the pre-injection jets.

In operation, fuel is injected in the form of jets shown diagrammatically at 4*b*, 5*b*, 6*b*, and 7*b* for main injection and at 8*b*, and 9*b* for pre-injection. The relative directions in which the two sets of holes point and the angles of the cones on which the axes of the holes lie are selected so to minimize the distances between the jets 8*b* and 9*b* and zones 4*c*, 5*c*, 6*c*, and 7*c* situated halfway along the spray path of main injection jets, as can be seen in FIG. 2.

Depending on the dimensions of the combustion chamber, it may be advantageous to increase or to reduce the number of spray holes, while nevertheless retaining the ratio of one to two between pre-injection holes and main injection holes.

Figure 3:
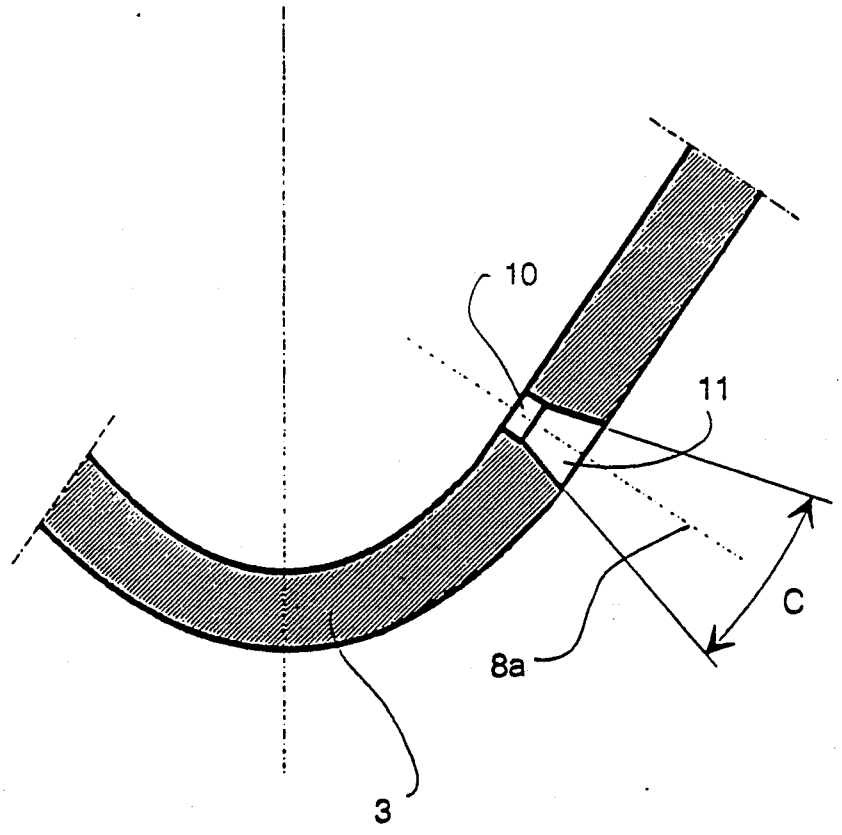
FIG. 3 is a fragmentary section through a pre-injection spray head.

FIG. 3 is a fragmentary section through the wall of the pre-injection spray head on a plane containing the axis 8*a* of one of its holes. The hole is made up of two portions: a cylindrical portion 10; followed in the fuel flow direction by a conical portion 11 which flares towards the combustion chamber. The conical portion makes it possible to spray of the fuel over a cone having an angle C which is greater than that that can be obtained using a hole which is cylindrical only.

The distribution of the pre-injection jets and of the main injection jets combined with the use of flared pre-injection holes in accordance with the invention makes it possible to enlarge the range over which the engine can operate while using a single fuel of low ignition quality towards the low-load and low-speed end of the range when the fuel is used both for pre-injection and for main injection. When the operating limit using a single fuel is reached, then it is appropriate to use a pre-injection fuel of higher ignition quality.

It is preferable to perform injection using two spray heads combined in a single body as described, for example, in U.S. Pat. No. 4,524,737.

I claim:

1. In a fuel injection device for an internal combustion engine, in particular a diesel engine, the device comprising a first, pre-injection spray head for pre-injection of fuel and a second, main injection spray head for main injection of fuel, said spray heads being situated close to each other in the vicinity of the middle of a cylinder head, being provided with fuel spray holes that are equidistant, and being under the control of different needles, the improvement wherein said pre-injection spray head includes a series of spray holes having axes which lie on a first cone and said main injection spray head includes a series of spray holes having axes which lie on a second cone, said main injection spray head holes being twice in number to the spray holes of the pre-injection spray head, and wherein the relative positions of the cones, the angle of each of the cones, and the directions of the axes of the holes around the cones being selected such that the distances between each pre-injection jet and two adjacent main injection jets are at a minimum and are substantially equal in a zone which is situated substantially halfway along the length of the main injection jets.

2. A fuel injection device according to claim 1, wherein the holes of the pre-injection spray head comprise, in the fuel flow direction, a cylindrical portion followed by a flared portion which is flared towards the combustion chamber, with the length of each flared portion being less than 80% of the head wall thickness.

* * * * *